United States Patent [19]

Vervoordt et al.

[11] 4,373,476

[45] Feb. 15, 1983

[54] ROTARY VALVE SYSTEM

[76] Inventors: Joseph P. Vervoordt, 432 Monroe Ave.; Joseph J. Gorzynski, 259 Prospect Ave., both of New Milford, N.J. 07646

[21] Appl. No.: 128,293

[22] Filed: Mar. 7, 1980

[51] Int. Cl.[3] ..... F01L 7/06

[52] U.S. Cl. ..... 123/80 D; 123/190 BD; 123/190 D

[58] Field of Search ..... 123/80 R, 80 BB, 80 D, 123/80 DA, 190 R, 190 B, 190 BD, 190 D, 190 DA, 190 DL, 190 E

[56] References Cited

U.S. PATENT DOCUMENTS

| | | | |
|---|---|---|---|
| 1,282,602 | 10/1918 | Lindstrom | 123/190 D |
| 2,283,594 | 5/1942 | Aspin | 123/190 D |
| 2,457,206 | 12/1948 | Carlson | 123/190 D |
| 3,130,953 | 4/1964 | Carpenter | 123/190 D |

FOREIGN PATENT DOCUMENTS

| | | | |
|---|---|---|---|
| 1911617 | 6/1970 | Fed. Rep. of Germany | 123/190 D |
| 782071 | 5/1935 | France | 123/80 D |
| 375666 | 6/1932 | United Kingdom | 123/80 D |
| 396641 | 8/1933 | United Kingdom | 123/190 D |

*Primary Examiner*—Craig R. Feinberg
*Assistant Examiner*—W. R. Wolfe
*Attorney, Agent, or Firm*—Spellman & Joel

[57] ABSTRACT

A rotary valve system for use in internal combustion engines comprises an elongated substantially cylindrical valve passage means having a threaded section at one end and an outwardly extending disc portion at the other end. The outwardly extending lower portion includes a valve disc aperture for alternate communication with inlet and outlet passages in the valve disc jacket for predetermined time periods. The bottom of the disc portion comprises the upper surface of the combustion chamber and can include a shaped protrusion for purposes of charge stratification. Rotation means support the valve disc arrangement for rotation within the cylinder head or valve disc jacket about the longitudinal axis of the assembly. The inner recess of the valve disc jacket which contacts the outwardly extending valve disc is provided with a mating carbon, graphite or molybdenum impregnated sleeve insert. Means may also be provided to couple the cylindrical passage means to a plurality of similar valve arrangements in particular engines.

5 Claims, 54 Drawing Figures

ROTARY VALVE SYSTEM

BACKGROUND OF THE INVENTION

This invention relates to internal combustion engines and particularly to a new and improved rotary valve system for use in connection with such engines.

The more pertinent prior art discloses various internal combustion engines with rotary valve systems including U.S. Pat. No. 1,492,263 to H. J. Pocock, U.S. Pat. No. 1,539,041 to J. F. Crawford, U.S. Pat. No. 1,169,662 to D. J. McKinnan and U.S. Pat. No. 1,664,056 to J. Astrom. The more recent U.S. Pat. No. 4,033,317 to F. M. Aspin discloses the current state of the art on internal combustion engines including a valve rotor which in this case is utilized in conjunction with a reciprocable piston. These patents essentially disclose that rotary valve systems per se are old but their teachings are nevertheless not directly applicable to the specific system disclosed herein which possesses substantial advantages thereover.

Applicant also has a pending application, U.S. Ser. No. 34,727, filed May 14, 1979, which discloses a new and improved rotary valve system. The present invention, however, is an improvement thereover which has considerable advantages including cost of manufacture. The subject internal combustion engine arrangement has no cam shaft, substantially reduced valve drive losses, has superior lubrication and permits spinning the engine at approximately double the speed and double the brake horsepower of sophisticated conventional arrangements and improved combustion characteristics through vortex type charge stratification. The invention also provides rapid opening and closing of valve passages and fewer obstructions to air-fuel mixture. The operation of the system also produces a flattened torque curve in an embodiment utilizing particular pressure differential valves.

SUMMARY OF THE INVENTION

This invention relates to a rotary valve system for internal combustion engines and particularly to a new and improved rotary valve disc unit for use in such engines.

The rotary valve system of the invention comprises a hollow cylindrical vertical portion extending outwardly from a disc portion, the lower surface of which forms the top of the combustion chamber. The disc portion includes a recess extending therethrough to the combustion chamber to periodically communicate with inlet and outlet passages in the valve disc jacket. The surface of the combustion chamber formed by the disc portion can be provided with surface irregularities such as fins to aid charge stratification. The inner recess of the valve disc jacket which contacts the outwardly extending valve disc is provided with a mating carbon, graphite or molybdenum impregnated sleeve insert. In multiple cylinder engines, a pulley arrangement can be utilized to couple the various rotary valves.

The present rotary valve invention involves both a ring seal valve disc type and a vertical thrust valve disc. The ring seal units are provided with a valve disc ring seal including a aperture which cooperates with the disc recess. The vertical thrust units lack the ring seal and vertical splines on the stem. Pressure differential reactive valves may be provided in the inlet and exhaust passages.

Accordingly, an object of this invention is to provide a new and improved rotary valve system for use with internal combustion engines.

Another object of this invention is to provide a new and improved rotary valve system with a rotary valve having improved combustion characteristics.

BRIEF DESCRIPTION OF THE DRAWINGS

Other objects and advantages may be seen from the following description when viewed in conjunction with the accompanying drawings wherein.

DETAILED DESCRIPTION OF THE INVENTION

Figure 1A:
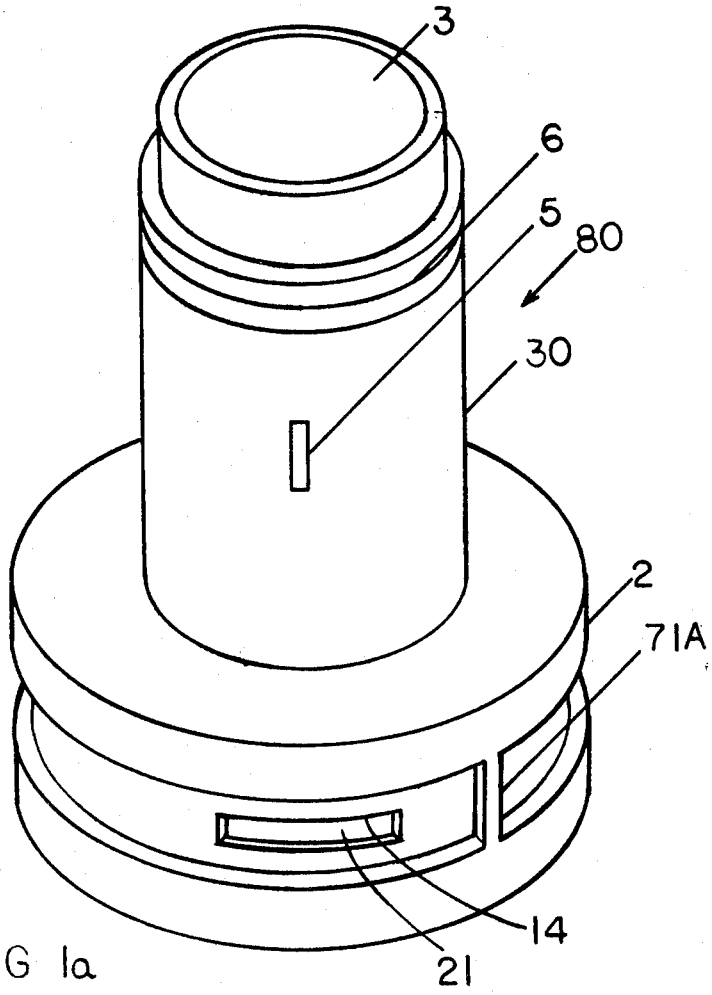
FIG. 1*a* is a perspective view of a ring seal valve disc unit and 1*b* is a perspective view of a ring seal designed to engage the unit of FIG. 1*a;*
Figure 1B:
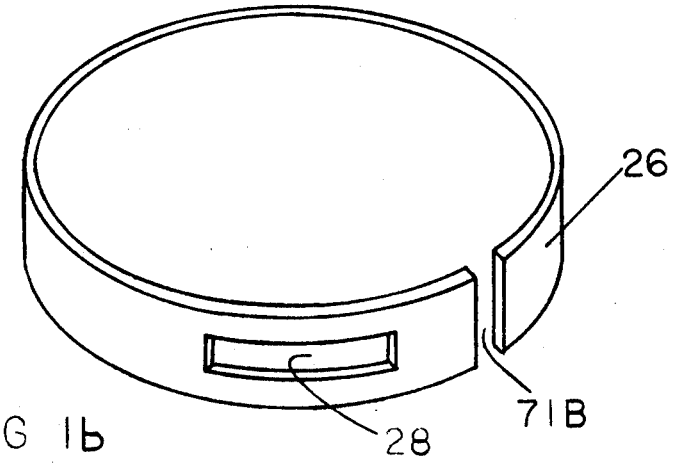
Figure 2B:
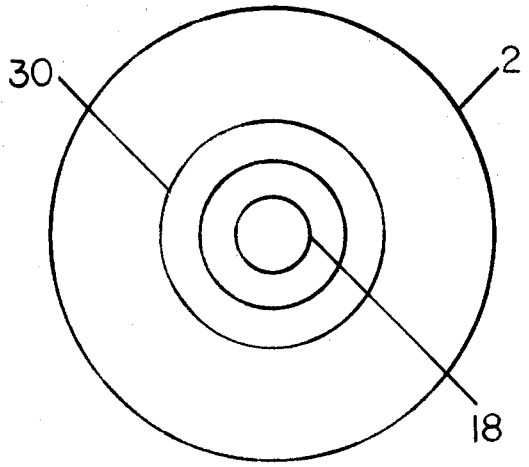
FIG. 2*a* is a side view of a ring seal valve disc unit with internal portions shown in dashed lines and FIG. 2*b* is a top view of the valve disc unit.
Figure 2A:
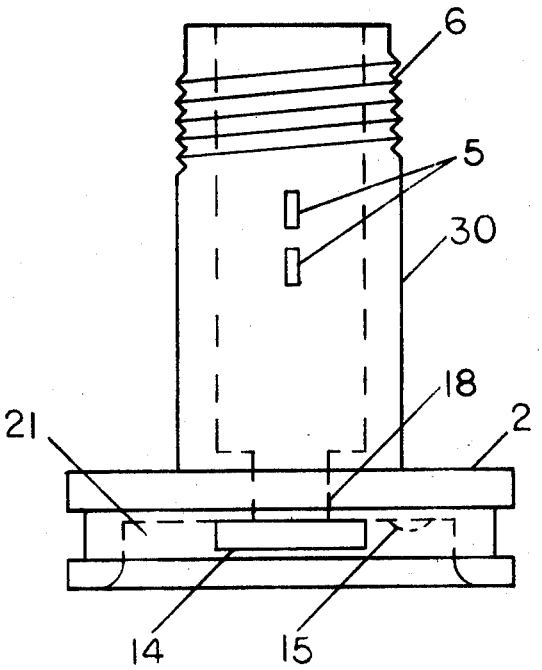

Referring now to the drawings, the invention comprises a rotary valve system for internal combustion engines which has two embodiments, a ring seal valve disc type 80 or the vertical thrust seal valve disc type 90. The ring seal type 80 is perhaps most clearly shown in FIGS. 1*a* and 2*a* while the vertical thrust type is illustrated particularly in FIGS. 3*a* and 4*a*. The basic one-piece valve disc unit 80 of the ring seal type, as shown in FIGS. 1*a* and 1*b* of the drawings, comprises a disc portion 2 and a stem portion 30 which extends vertically upward from the top surface of the disc portion 1. The stem 30 is substantially cylindrical in shape and can include a central aperture along the axis thereof in order to receive a spark plug 49 therein, the firing end of which is exposed to the combustion chamber 21.

The combustion chamber 21 is located within a lower recess in the valve disc portion 1 and below the point of juncture of valve disc 1 to valve stem 30. The combustion chamber 21 is preferably provided with surface irregularities 15 such as fins, vanes etc., see FIGS. 12–13 to provide a vortex within the fuel mixture for charge stratification. An aperture 14 extends through the recessed wall 2 of the valve disc portion 1 at a predetermined angle providing communication between the outer surface of the valve disc portion 1 and the combustion chamber 21. The aperture 14 is designed to occupy a predetermined portion of the disc curcumference for timing purposes as it communicates with inlet and outlet passages in the valve disc jacket 17.

The vertical axis of the valve disc unit 1 corresponds with the axis of the engine piston cylinder bore 50 within which it is located. The valve disc jacket 17 is similar to the cylinder head on poppet-valve type internal combustion engines in that the valve disc unit 1 is housed in and operates within the jacket 17 which is rigidly mounted in the usual manner on top of the piston cylinder bore 50.

Figure 7:
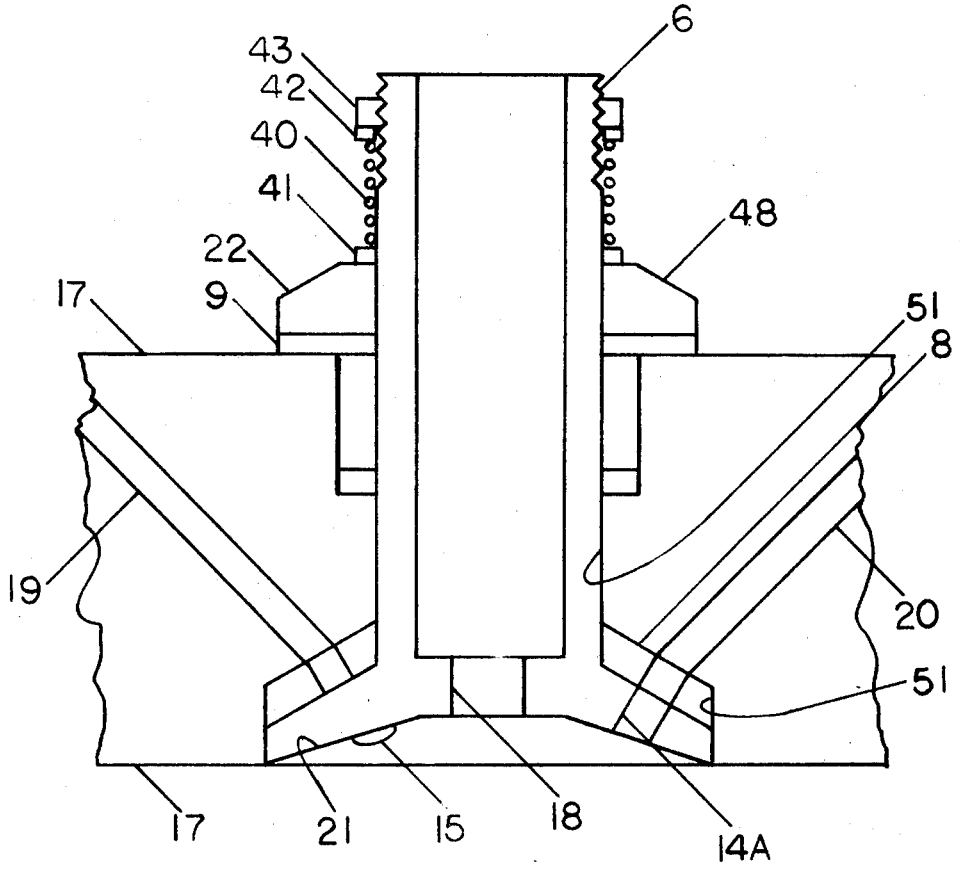
FIG. 7 discloses a vertical thrust valve disc unit mounted in a valve jacket.

Valve disc jacket 17 is provided internally, see FIG. 7, with one or more bearings 16 within which the valve stem 30 rotates. The upper external surface of the valve disc portion 2 rides against a ball, roller, plain metal or carbon thrust bearing 42. The inner recess 51 of the valve disc jacket 17 which engages the valve disc portion 1 is provided with a carbon, graphite or molybdenum impregnated carbon sleeve insert 8, said valve disc jacket sleeve insert 8 having a shape corresponding to the valve disc portion configuration which it engages. The valve disc jacket sleeve insert 8 is maintained in position through screwing or pegging (not shown) to the sleeve recess 51 in the valve disc jacket 17.

The ring seal valve disc units are provided with a recess or groove 4 to accept the valve disc ring seal 26 which is similar to the common piston ring except for a greater height. The increased height is necessitated by the presence of a slot 28 in the disc portion.

Figure 8A:
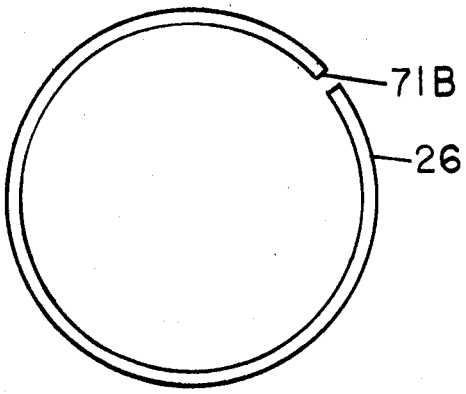
FIGS. 8*a, b,* and *c* disclose various types of ring seals which engage the disc units 8*d, e, f,* respectively and FIGS. 8*g* and 8*h* disclose side views of the valve discs engaged by the ring seals.
Figure 8D:
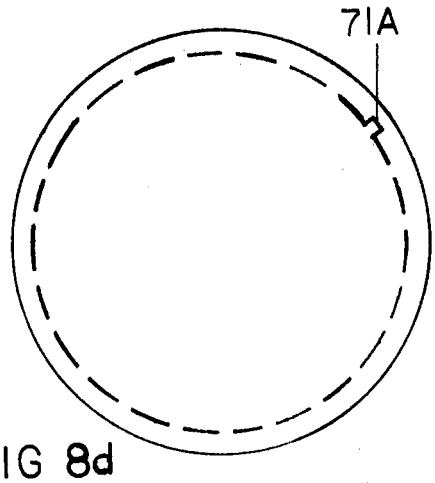
Figure 8B:
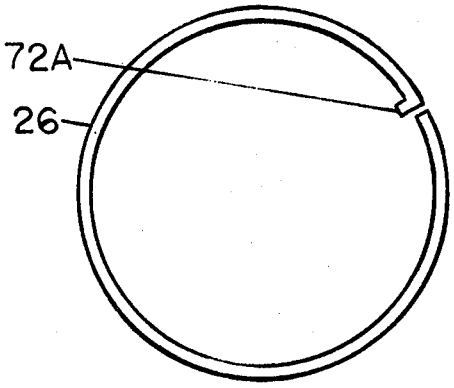
Figure 8E:
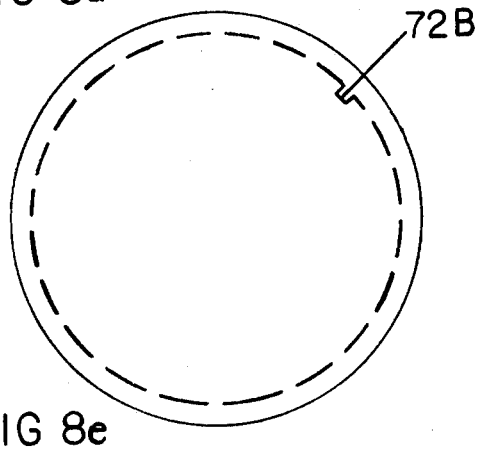

The ring seal slot 28 is maintained in alignment with and is shaped similar to the valve disc aperture 14. Alignment is maintained through employment of locating lips 27 on the valve disc which are positioned in the valve disc ring groove 4 for the purpose of registering with the valve disc ring seal gap 71. Alternatively, the lip 72*a* can be located on the valve disc ring seal 26 as in FIG. 8*b* for the purpose of registry with a valve disc ring groove locating slot 72*b*, see FIG. 8*e*. The valve disc ring seal 26 can be relieved about its perimeter except in the area of the valve disc ring seal slot 28*a* as illustrated by number 4.

Figure 9:
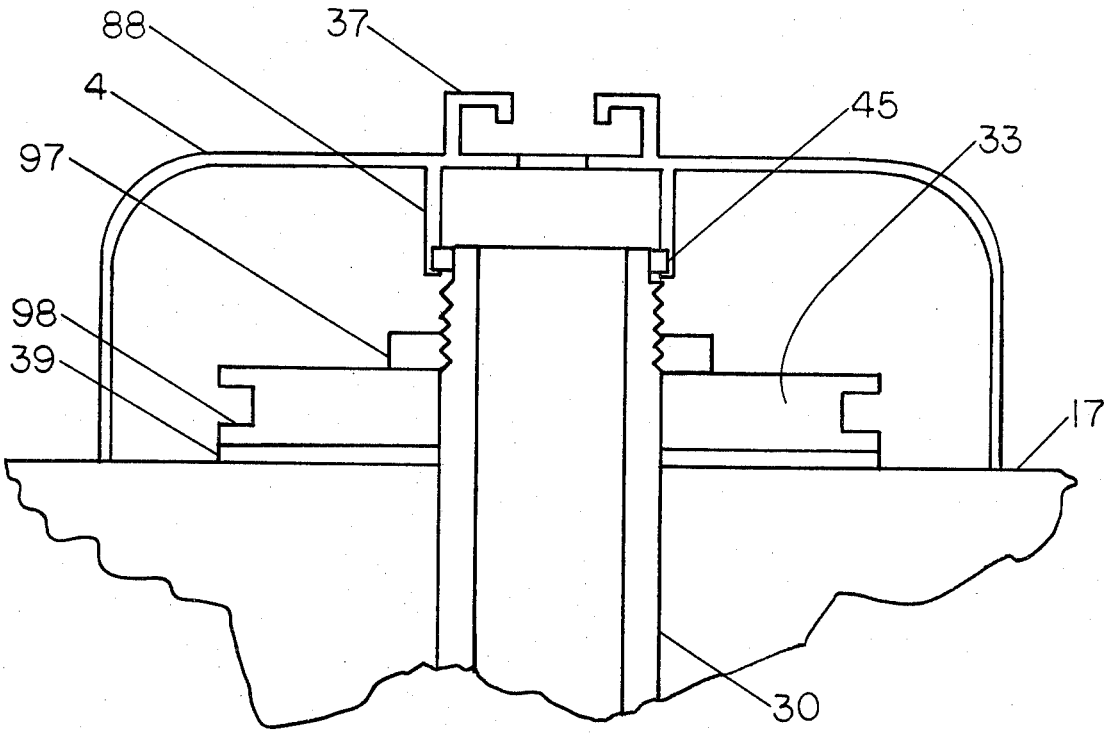
FIG. 9 discloses a mounting of the ring seal type valve stem portion in the valve disc jacket with a cover thereover.

The valve stem portion 30 of the ring seal embodiment 80 of the invention is provided with one or two keyways 5 and upper threaded section 6 which receives a threaded pulley locking nut 97 (FIG. 9). The area from immediately above the threaded section 6 to the upper portion of the valve stem 30 is suitably narrow so that the pulley locking nut 97 can be threaded thereon and provide a suitable surface for oil seal 45 to make dynamic contact therewith.

Pulley locking nut 97 threads onto threaded section 6 to retain a keyed bevel gear 48*d* and/or one or two keyed valve drive pulleys 98, which are designed to register with keyways 5 in valve stem 30. A thrust washer 39 is interposed between the lower face of keyed bevel gear 48*d* or valve drive pulley 98 and the upper external surface of the valve disc jacket 17.

Figure 6:
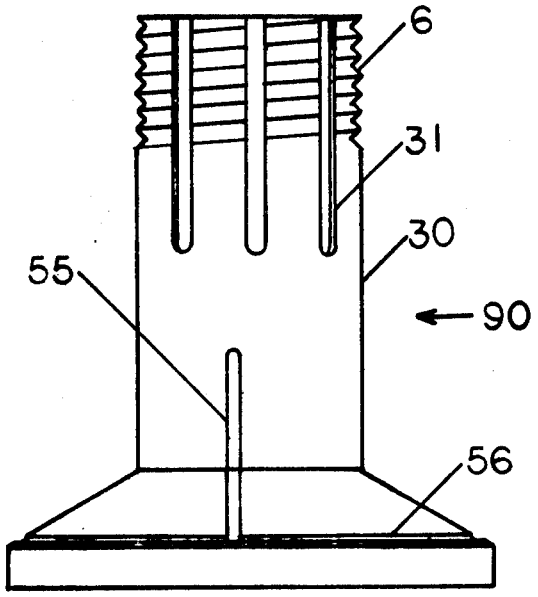
FIG. 6 shows a vertical thrust valve disc unit with oil grooves located therein.

Wet lubrication can be provided to the interface of the external surface of the valve disc portion 1 and the inner surface of valve disc jacket sleeve insert 8 by elongated oil grooves 55 cut into the outer surface of valve disc portion 1, see FIG. 6. The oil grooves 55 are drip or pressure fed through the valve disc jacket 17 body or from the bottom area of the valve stem bearings 16. Alternatively, oil can be pressure fed to the interface of valve disc jacket sleeve 8 and valve disc unit 1 through a suitable provision in valve disc jacket sleeve 8.

The oil grooves 55 can be positioned in any manner so as to obtain a desired degree of wet lubrication. Also, as shown in FIG. 9, a collector groove 56 can be employed which interconnects all vertical grooves 55 and registers with the oil collector return passages 57 in the valve disc jacket 17 and sleeve insert assembly. The oil collector passages 57 are arranged circumferentially about the valve disc portion 1.

Figure 3B:
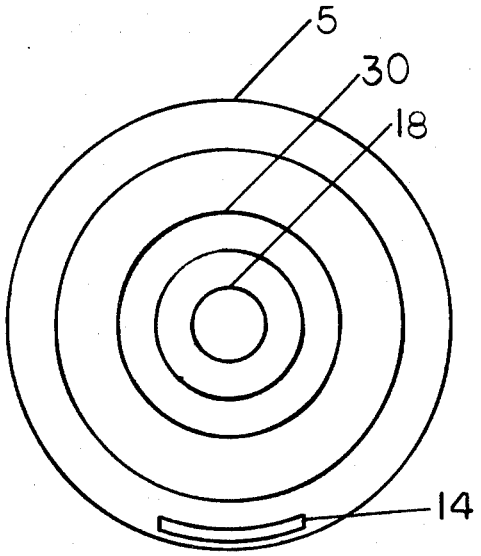
FIG. 3*a* is a side view of a vertical thrust type valve disc unit with parts shown in outline and FIG. 3*b* is a top view of the valve disc unit.
Figure 3A:
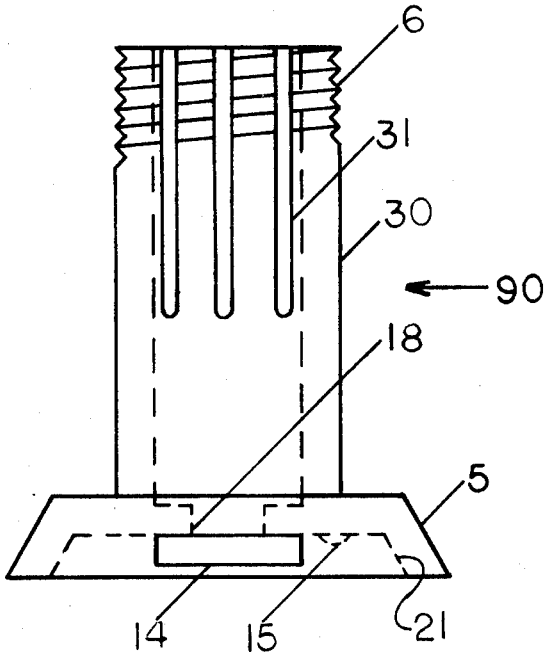
Figure 4B:
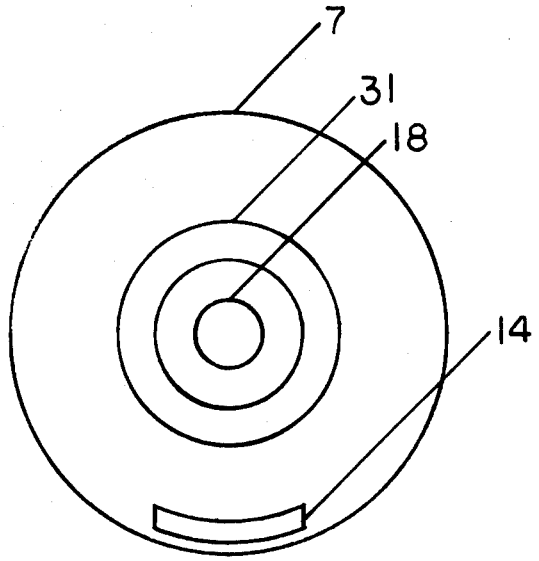
FIG. 4*a* is an alternate embodiment of a vertical thrust valve disc unit and FIG. 4*b* is a top view of said unit.
Figure 4A:
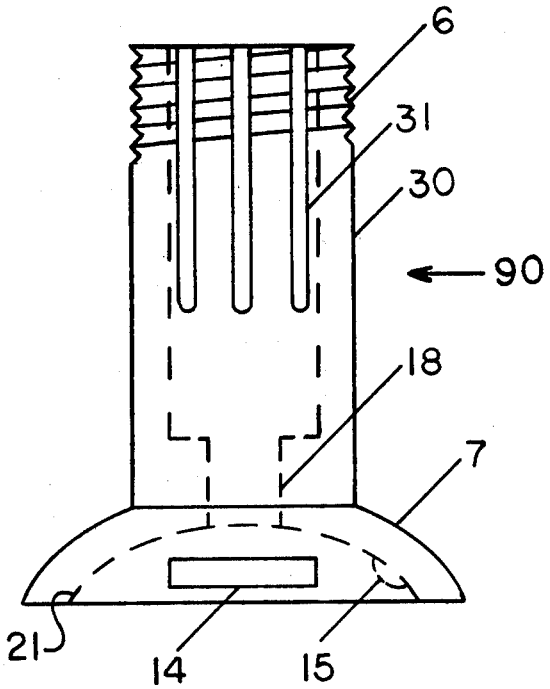
Figure 5:
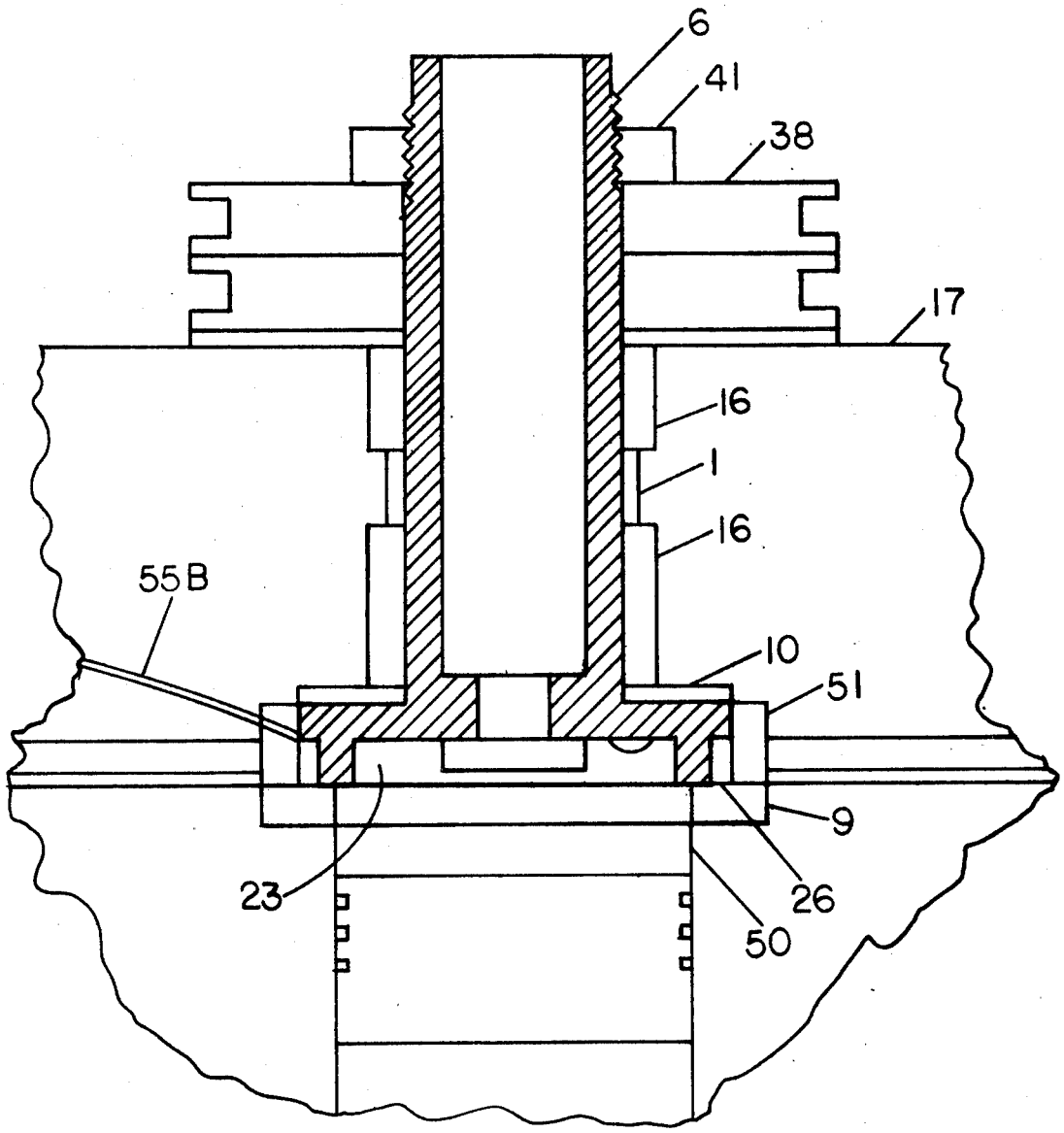
FIG. 5 is a cross-sectional view of a ring seal valve disc unit mounted in the valve disc jacket.

The second embodiment of the invention comprises a vertical thrust seal valve disc unit 90 which is particularly shown in FIGS. 3*a* and 4*a*. The primary structural difference between the embodiments 80 and 90 is the absence of any ring seal 26 in the vertical thrust unit 90 as well as the provision of splines 31 on the valve stem portion 30. The splines 31 extend downwardly from the upper land of valve stem 30 to an intermediate point on the splines 31.

An internally threaded seal retainer 43 engages the threaded section 6 and retains, under compression, upper spring bearing 42, compression spring 40, lower spring bearing 41, an internally splined bevel gear 48 and/or one or two internally splined valve drive pulleys 33, all of which are in a sliding fit on valve stem splines 31 and a lower thrust washer 39 in that order.

As shown in FIG. 7, a gas inlet port 19 and an exhaust port 20 extend from the inner surface of the valve disc jacket sleeve insert 8 and through the body of valve disc jacket 17 to its external surface. At the inner surface of the valve disc jacket sleeve insert 8, the inlet port 19 and exhaust port 20 are positioned along the same horizontal plane and as the valve disc aperture 14 when the valve disc unit 1 is in place.

The inlet gas passageway runs from the inlet port 19 through the valve disc jacket 17 and sleeve insert 8, the valve disc ring seal slot 28 and the valve disc aperture 14. The exhaust gas passageway, on the other hand, runs from the exhaust port 20 through the valve disc jacket 17 and sleeve insert 8, the valve disc ring seal slot 28 and the valve disc aperture 14.

the valve disc aperture 14 and valve disc ring seal slot 28 are common to both inlet 19 and exhaust gas 20 passageways. Thus, if one were to rotate valve disc unit 1 about its vertical axis inside valve disc jacket 17, the inlet gas passageway 19 and exhaust gas passageway 20, would be alternatively opened, FIG. 8*a*, and closed to the combustion chamber 21, FIG. 8*b*.

Figure 14A:
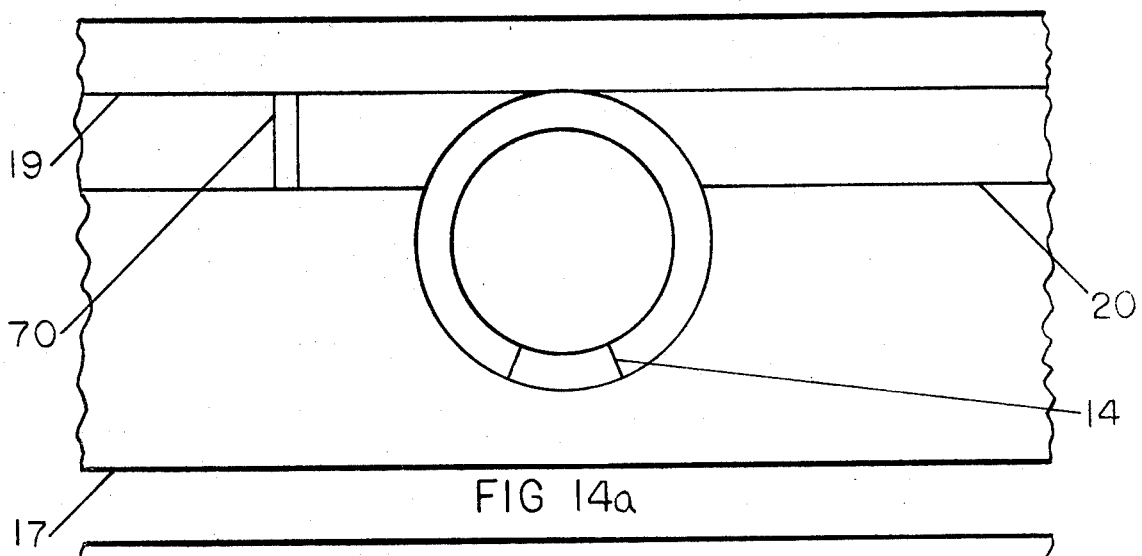
FIGS. 14*a* and *b* disclose schematically a timing arrangement for the rotary valve disc unit and FIG. 14*c* discloses a diesel arrangement.
Figure 14B:
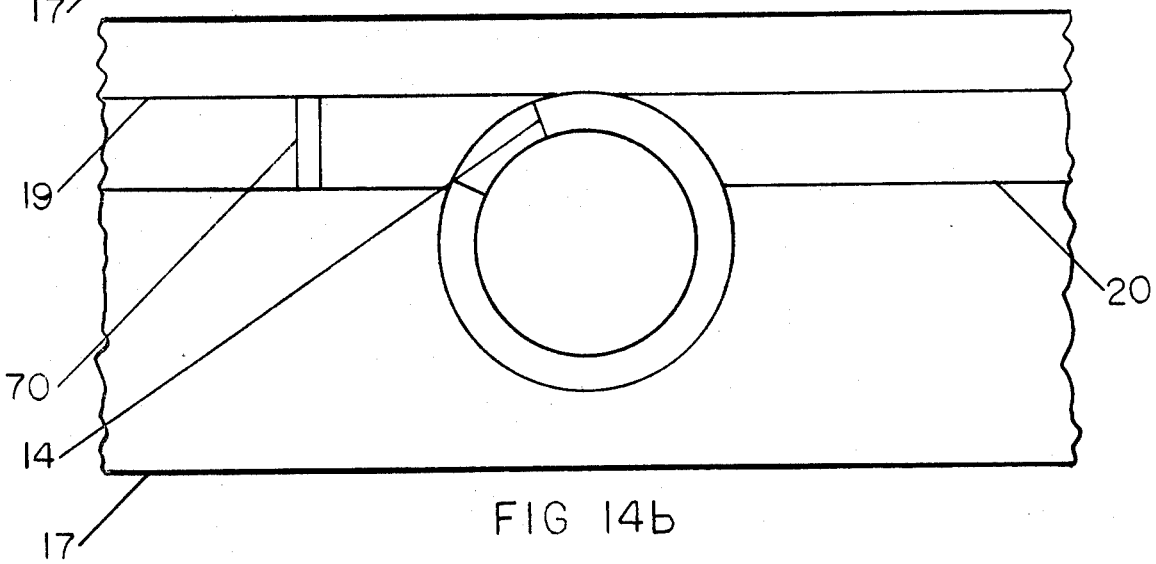
Figure 14C:
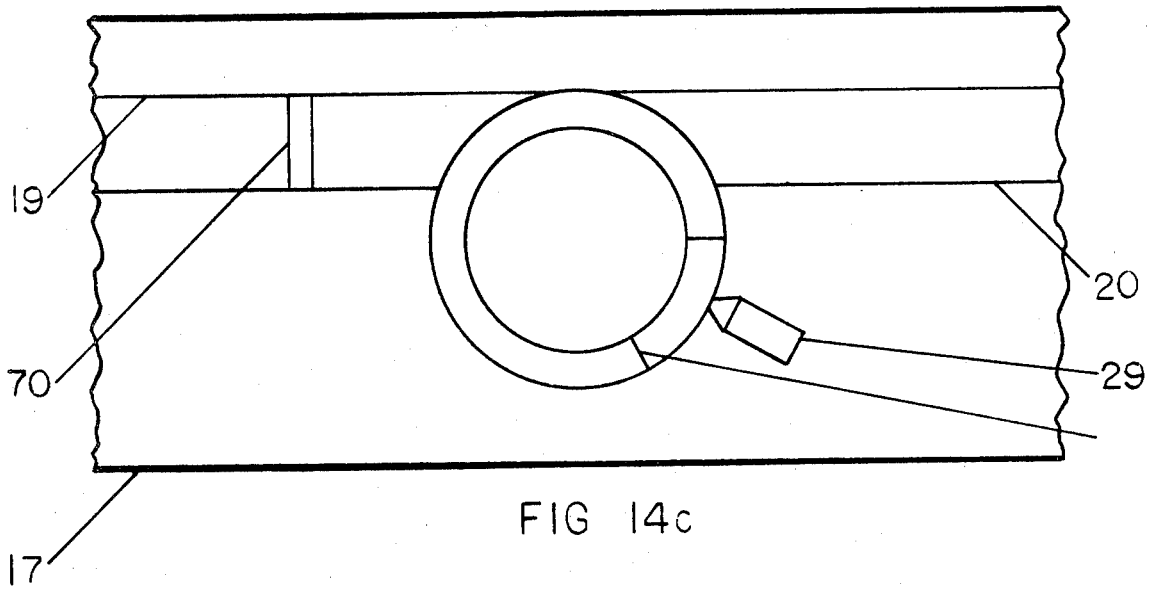

Diesel operation is shown in FIG. 14*c* and is attained by positioning diesel fuel injector 29 with its outlet end exposed to the external surface of valve disc unit 1. As the piston approaches TDC of the combustion stroke, the valve disc aperture 14 will be in front of said injector 29 outlet end, thus providing a passage through which fuel can enter the combustion chamber 21.

Referring to FIGS. 15, 20 and 21*a*–21*b*, a diaphragm type pressure differential reactive valve 70 may be placed in the inlet gas passageway 19. The diaphragm type pressure differential reactive valve 70 comprises a metal or plastic outer frame 74 having three or more negative pressure stops 70B of narrow section which extend across the inner area of the outer frame 74 at another point. The edges of adjoining tongues 75 rest against their two common negative pressure stops 70B. As such, one tongue 75 shares two negative pressure stops 70B with its two flanking tongues 75, there being an equal number of tongues 75 and negative pressure stops 70B. The tongues are dimensioned so as to yield (bend) a specific amount in the direction of the combustion chamber 21 as a result of gas forces acting upon them. The diaphragm valve unit 70 is mounted with tongues 75 on the combustion chamber side, and the negative pressure stops on the atmosphere side.

Figure 19:
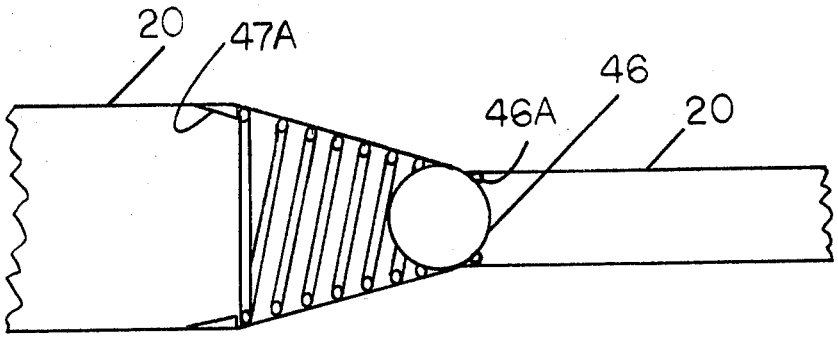
FIG. 19 discloses a ball type pressure differential reactor type valve unit.
Figure 20:
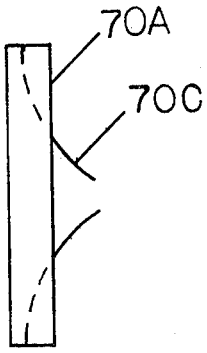
FIG. 20 discloses a side view of diaphragm type pressure differential reactor valve.
Figure 21A:
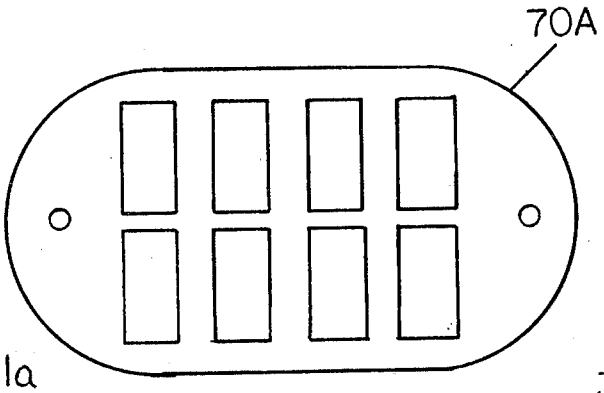
FIG. 21*a* discloses a diaphragm type pressure differential reactor valve frame.
Figure 21B:
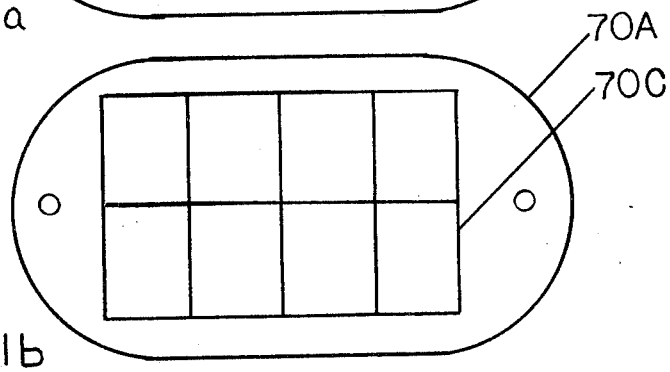
FIG. 21*b* discloses a complete diaphragm type pressure differential reactor valve; and, FIG. 22 discloses a top view of a valve disc arrangement involving several sparks, and FIG. 23 discloses a cross-sectioned view of the disc arrangement of FIG. 22 taken along the line A—A.

A second type of pressure differential reactive valve, the ceramic ball-check valve assembly 46 of FIG. 19 can be positioned in the exhaust gas passageway 20. A fuel injector 25 is provided with pressure differential reactive valve 70 where fuel injection is employed.

Figure 17B:
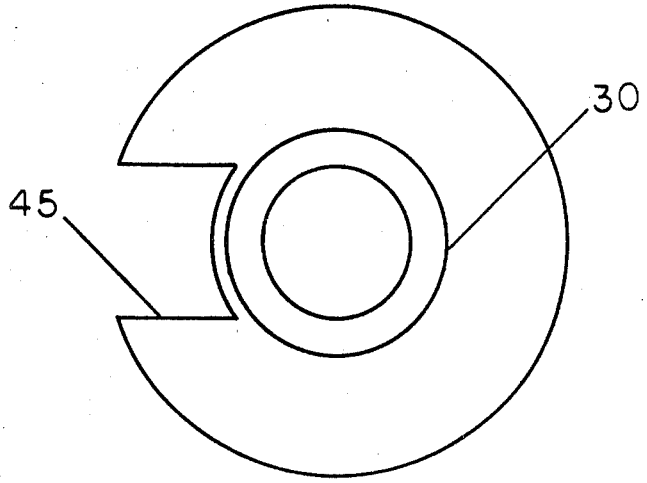
FIG. 17*a* and *b* disclose a rotary valve disc unit having a side aperture for additional access to the combustion chamber.
Figure 17A:
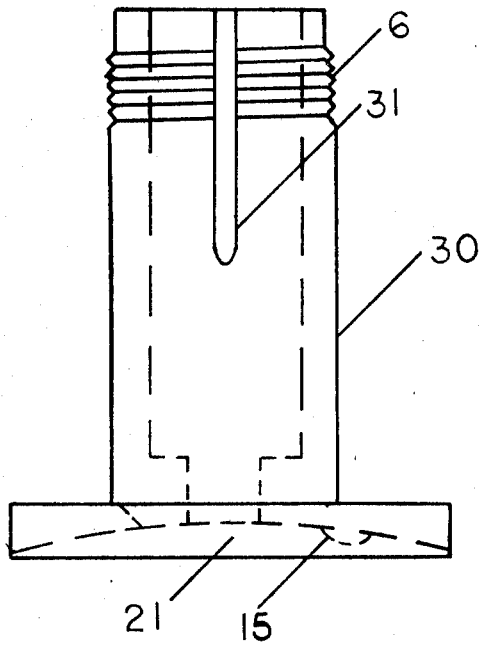
Figure 22:
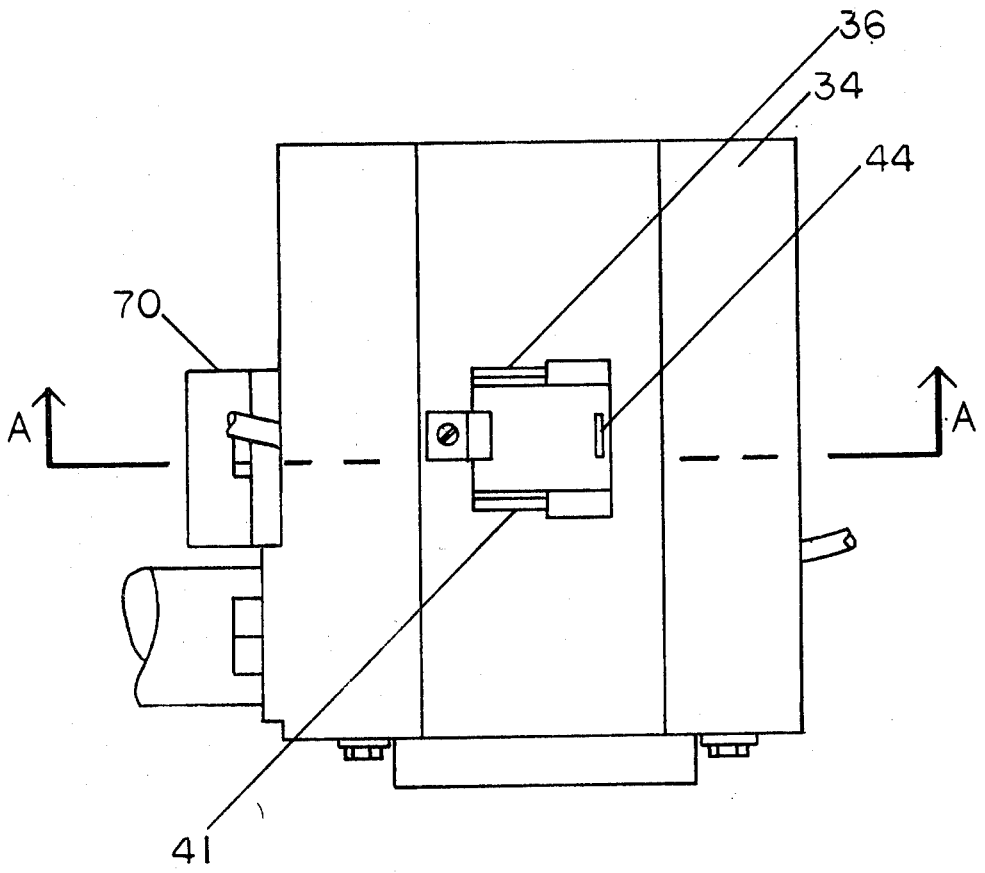
Figure 23:
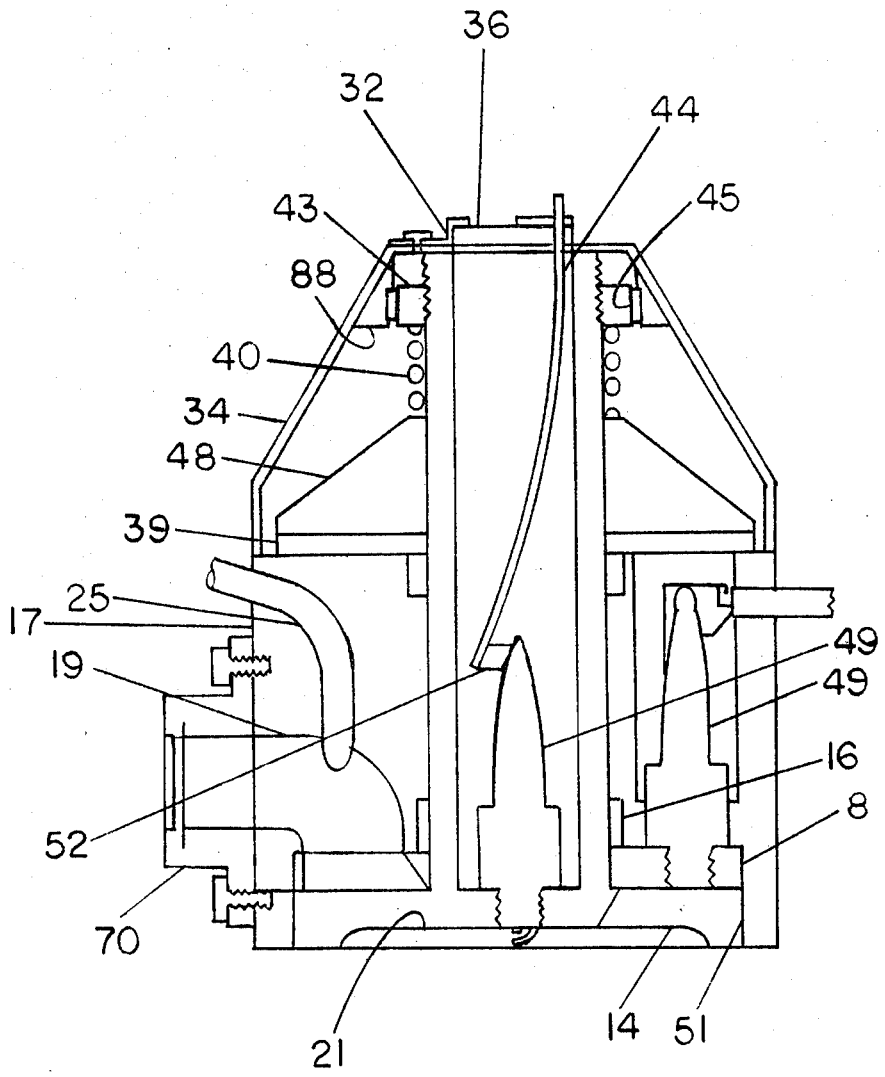

As shown in FIGS. 17 and 22, a second spark plug 49B can be placed in a suitable recess in the body of valve disc jacket 17 with its firing end exposed to the external surface of the valve disc portion 1 so that at an appropriate point in the rotation of the valve disc unit 1 in the valve disc jacket 17, the firing end of said spark plug 49B will be exposed to the combustion chamber 21 and capable of igniting the inlet charge.

Figure 15:
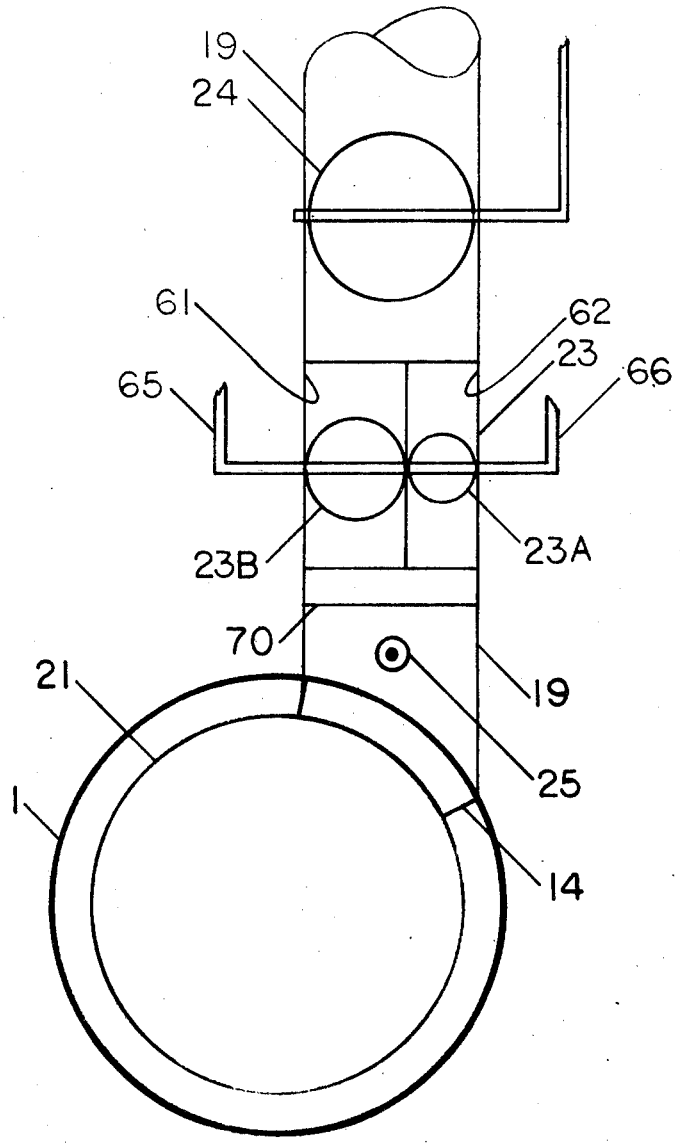
FIG. 15 discloses a combustion chamber with a diaphragm differential reactor valve employing butterfly openings.

The gas inlet passageway 19 may also be fitted externally with a 2-stage air flow modifier 23 in conjunction with common port type fuel injection systems as illustrated in FIG. 15. The two-stage air flow modifier 23 comprises a single casting having a pair of passages 61 and 62 of unequal area cut through from top to bottom. The cross-sectional area of both passages 61 and 62, when summed, equals or exceeds the cross-sectional area of the inlet port 19 in the valve disc jacket 17. Two suitably shaped butterflys 63 and 64 are fitted on interlocking yet independently acting rods 65 and 66, which are both fitted with an appropriately designed progressive linkage. The two-stage air flow modifier 23 is located between the usual throttle butterfly and the pressure differential reactive valve 70.

Figure 16A:
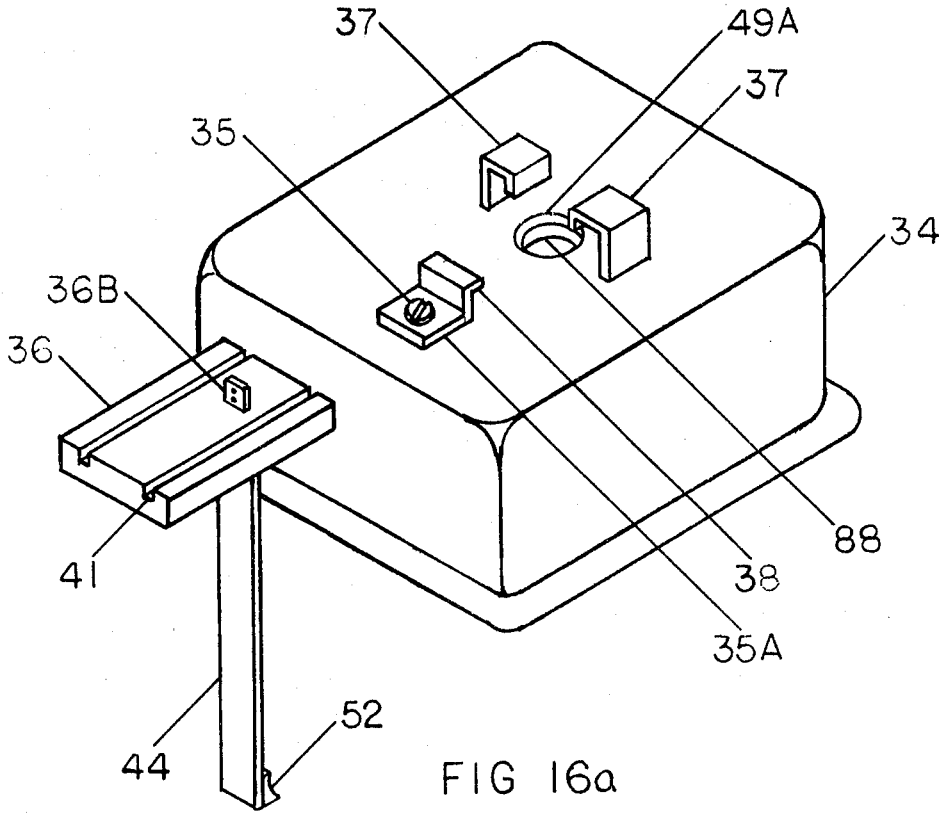
FIG. 16*a* discloses the electrical set up of the valve disc unit with FIG. 16*b* showing contact brush and FIG. 16*c* showing the brush making contact with the spark plug.

Referring to FIGS. 9 and 16*a*, the valve gear cover 34 is similar to the common valve gear covers found on poppet-valve Otto cycle engines except for a central opening 32 on the top surface which is flanked by two inverted 'L' brackets 37. The opening 32 is located above the valve disc stem 30 and is provided with an internal valve stem oil seal housing 88 which is essentially an open-ended cylinder. The valve stem oil seal 45 is located in a suitable recess on the inner surface of the aforementioned valve stem oil seal housing 88. The valve stem oil seal housing 88 fits over the top of valve stem 30 or seal-retainer 43. Inside the cover 34 valve stem oil seal 45 makes dynamic contact with the upper external surface of valve stem oil seal-retainer 39. Inside the cover 34, valve stem oil seal 45 makes dynamic contact with the upper external surface of valve stem oil seal-retainer 29 on the vertical thrust seal species valve disc units 90 while on ring seal species valve disc units 80, the seal 45 is in direct contact with the external surface of valve stem 30.

Figure 16B:
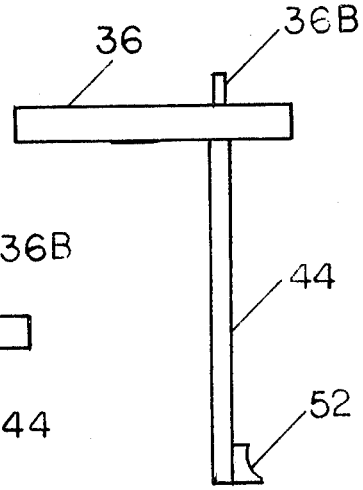
Figure 16C:
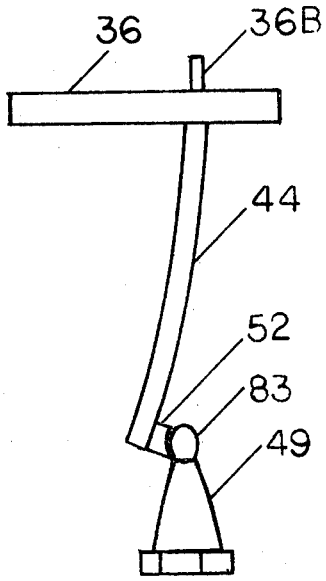

An electrical contact block 36 is provided comprising a plastic or Bakelite block having longitudinal tracks or grooves 41 cut into its upper surface for registry with the previously described inverted 'L' brackets on the valve gear cover 34. The electrical contact block 36 is molded around a contact strip 44 made of spring steel or similar material. The upper end of the strip is similar to standard electrical connectors while the bottom is provided with a carbon contact brush 52. An 'S' bracket 38 is mounted by screw 35 on the valve gear cover 34 as illustrated in FIGS. 16*a*–16*c*.

OPERATION

As shown in FIG. 1 of the drawings, the ring seal embodiment 80 of the invention comprises a valve disc unit 1 with a ring seal 26 mounted about the lower portion thereof. The valve disc unit is rotated about its vertical center line and supported inside the valve disc jacket 17 by one or more bearings 16 which may be roller, ball, plain metal or carbon graphite type. The rotation causes the valve disc aperture 14 and ring seal slot 28 to alternately open and close to the corresponding valve disc jacket gas inlet port 19 and exhaust port 20. This regulates the inlet and exhaust gases into and out of the combustion chamber 21 and the engine piston cylinder bore 50 at coordinated intervals. It is to be noted that both gas inlet port 19 and gas exhaust port 20 lie along the same plane as the single valve disc aperture 14.

The regulation achieved by this design is similar to common cam shaft timing and is defined in the same manner, namely, degrees of opened and closed duration of the inlet and exhaust valve. The degrees of opening and closing are determined about the circle formed by the valve disc portion 1 and its surrounding valve disc jacket 17 and the sleeve assembly 8 as more clearly seen in FIGS. 8*a*–8*c* as well as degrees of crank shaft rotation as is normal. The valve disc unit 1 like the common cam shaft, is rotated at one-half crank shaft speed. Therefore, one degree of rotation of the valve disc unit 1 is equal to 2 degrees of crank shaft rotation.

The valve disc unit 14 occupies a certain number of degrees in the above-mentioned circle. Valve timing is determined in the following manner: If the valve disc jacket 17 inlet port 19 were to occupy 75° and a valve disc aperture 14 were also to occupy 75°, the total number of disc degrees for which there were to exist an open passage for the admission of gases would be 150°. Quite obviously, the area of communication increases and then decreases during the 150° period. Further, as valve disc unit 1 is rotated at one-half crank shaft speed, the corresponding number of crank shaft degrees equals 300°. The exhaust period is determined in the same manner. The valve timing of the inlet and exhaust periods relative to each other is determined by the number of degrees taken up by the inlet port 19, exhaust port 20, the number of degrees between them and the number of degrees occupied by the valve disc aperture 14.

Figure 8C:
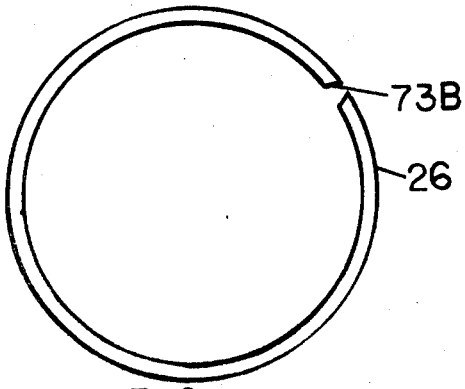
Figure 8F:
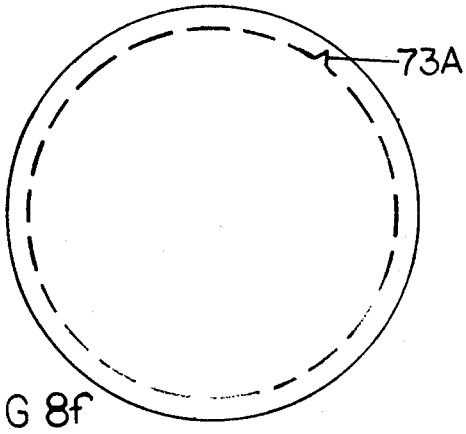
Figure 8G:
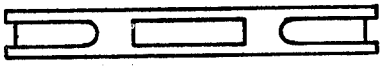
Figure 8H:
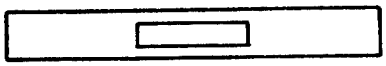

In diesel embodiments of the invention such as shown in FIG. 8*c*, a diesel fuel injector 29 whose outlet end is exposed to the external surface of valve disc unit 1 is utilized so that as the piston is approaching TDC of the combustion stroke, the valve disc aperture 14 will be in front of said injector outlet end and thus provide a passage through which fuel can enter the combustion chamber 21.

Port CFM capacity, gas velocities and gas flow characteristics can be closely controlled by variations in the shape and dimensioning of the various parts of the inlet 19 and exhaust 20 gas passageways and particularly by variations in the valve disc aperture 14. For example, if it were desired to maintain a constant inlet gas velocity from midstroke to where piston speed drops off at BDC, it would be necessary to systematically reduce the height of the valve disc aperture 14 towards its trailing (in rotation) end in order to maintain a constant ratio of piston speed to valve disc aperture 14 opened flow area. FIGS. 11–13 illustrate various configurations of the valve surface which are employed to provide desired gas flow characteristics.

Where port fuel injection is employed, inlet gas velocities can be further regulated through the employment of the two-stage air flow modifier 23 shown in FIG. 15. The air flow modifier operates as follows: when the opening of throttle butterfly 24 is small, only the primary butterfly 25 in the two-stage air flow modifier is open, thereby admitting the small quantity of air to the cylinder at a velocity higher than if the entire port cross-section were employed. As the throttle butterfly 24 is opened further, the primary butterfly 25 opens a commensurate amount, up to the point when the larger secondary butterfly 29 is actuated (opened) by the progressive linkage between the primary and secondary butterfly rods 65 and 66. At full throttle opening both primary 25 and secondary 29 butterflys are substantially fully opened.

Gas sealing is achieved by different means on the two species of valve disc units. On ring seal species valve disc units, gas sealing is effected by the ring seal 26 rotating within, and bearing directly against the inner surface of the valve disc jacket sleeve 8. The ring seal 26 is maintained in direct contact with the inner surface of valve disc jacket sleeve insert 8 by both the outward spring pressure of the ring itself, and the pressure of combustion gases against the back of the ring seal.

Alignment of the valve disc ring seal slot 28 is maintained through contact of a locating lip 27 with valve disc ring seal 26 at the ring seal gap 71B. Alternatively, ring locatint lip 72A can engage ring groove locating slot 72B. The valve disc ring seal 26 can be relieved about its perimeter, except in the area of the valve disc ring seal slot 28 for the purpose of reducing drive friction losses.

As shown in FIG. 9, valve drive pulley 98 and/or bevel gear 48 is/are rigidly located on valve stem 30 by way of single or double keyways 30, along with retaining nut 97 and thrust washer 39. Axial loading for combustion shocks are handled by the employment of a plain metal, ball, roller, or carbon-graphite thrust bearing 10 against which valve disc portion 1 rides.

On the vertical thrust seal species of valve disc units 90, the entire valve disc unit 1 is spring loaded upward into the valve disc jacket sleeve insert 8. This creates a gas seal at the valve disc unit to valve disc jacket sleeve insert interface, thereby isolating the combustion chamber 21 from both inlet 19 and exhaust 20 gas passageways during compression and combustion phases. Spring loading of the valve disc unit 3 into the valve disc jacket sleeve insert 8 is achieved by the compression spring 40 which may be of the coil type or leaf spring type. The spring 40 is retained under compression by the seal-retainer 30C at the upper land of springs 40 and by the valve disc pulley 38 or gear 48 at the bottom land of springs 40. Rotational friction occuring at the interface of the bevel gear 48 valve disc jacket 17 is substantially reduced by carbon-graphite, or plain metal thrust bearings 39, 40 and 42.

Friction and, consequently, heat are minimized by the aforementioned valve disc jacket sleeve 8, which can be self-lubricating and/or supplied with additional wet lubrication (e.g. oil-fed) where desireable thus eliminating the possibility of seizure. The wet lubrication is effected by oil grooves 55, oil collector groove 55A, and oil collector passages 55B. As operational wear occurs on the inner surface of the valve disc jacket sleeve insert 8 due to direct contact with the rotating valve disc unit 90, the entire valve disc unit is automatically pulled upward by compression spring 40 a distance equal to the amount of wear that has occurred in the vertical plane on the inner surface of valve disc jacket sleeve insert 8. To compensate for these upward axial movements of valve disc unit 90 into valve disc jacket sleeve insert 8, the internally splined valve disc pulley 38 or bevel gear 48A is also free to move downward axially on the splined section 31 of the valve stem portion 30. Similarly the valve disc unit 90 is free to move upward while valve disc pulley 38, or bevel gear 48A remain in the same horizontal plane. That is, valve disc pulley 38, or bevel gear 48A is constantly thrust downward against thrust bearing 39, which, in turn, is thrust downward against the upper external surface of valve disc jacket 17 by the expanding force of compression spring 40. This same expanding force bears axially upward against seal-retainer 30C, effecting a constant upward tensile on the entire valve disc unit 90 to which seal-retainer 30C is threaded.

Figure 10:
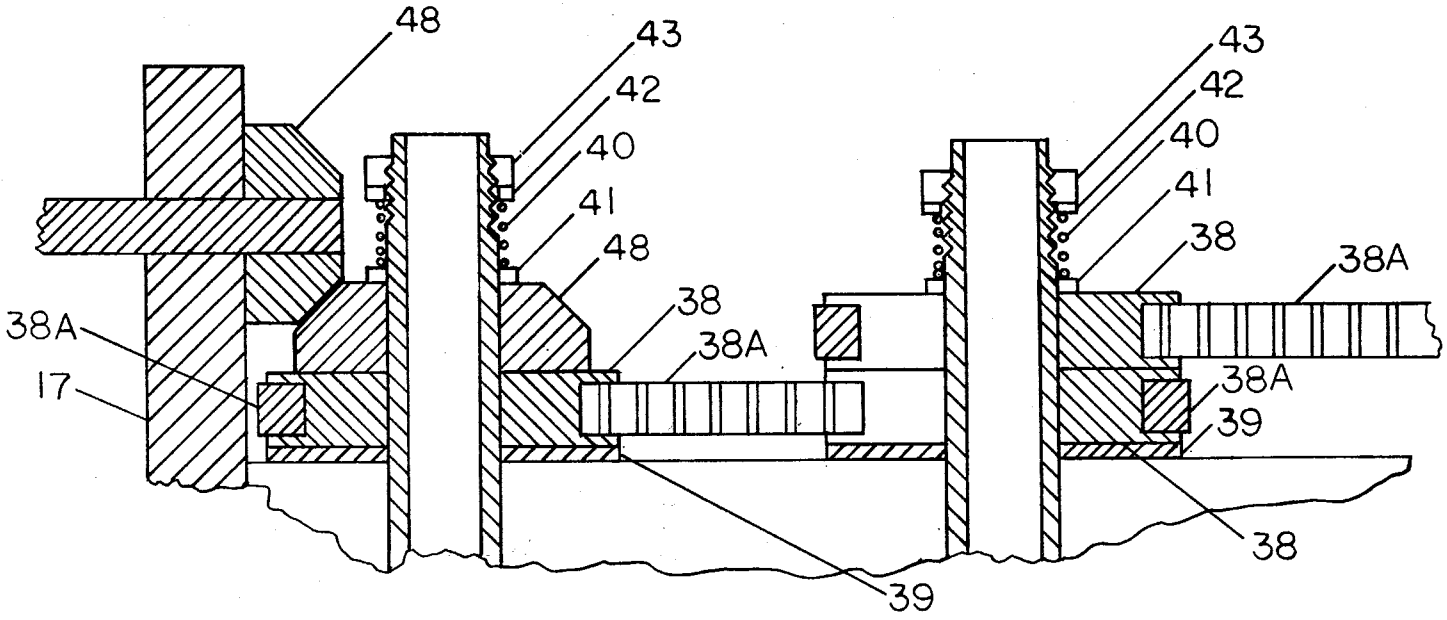
FIG. 10 discloses a multiple cylinder arrangement for vertical thrust seal type involving the present invention.
Figure 11A:
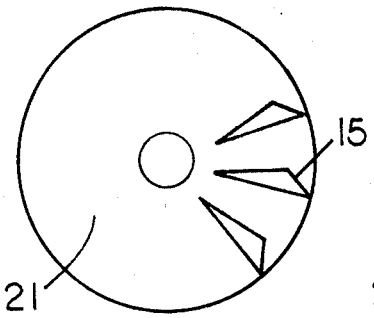
FIGS. 11*a, b, c* and *d* disclose various surface irregularities in the combustion chamber of the valve disc.
Figure 11B:
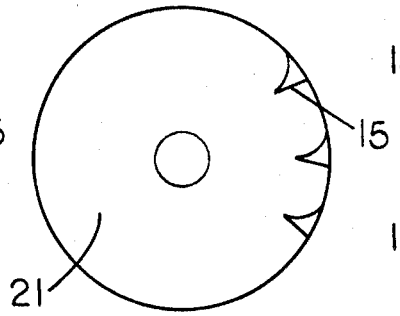
Figure 12A:
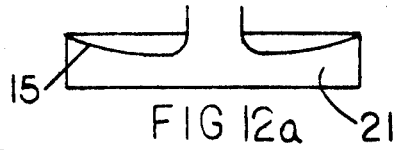
FIGS. 12*a*–12*h* disclose various surface irregularities and combustion chamber shapes of the valve disc portion.
Figure 12B:
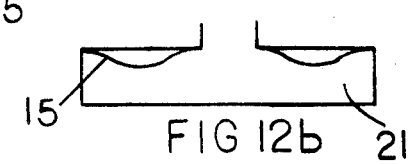
Figure 12C:
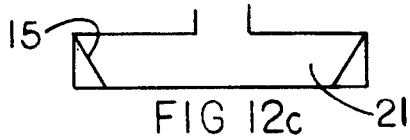
Figure 11A:
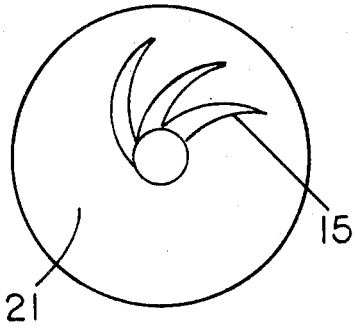
Figure 11D:
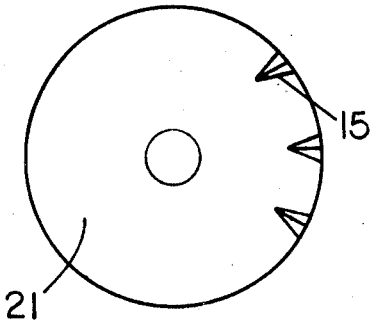
Figure 12D:
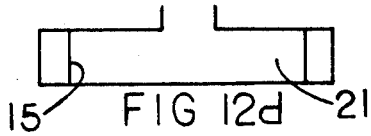
Figure 12E:
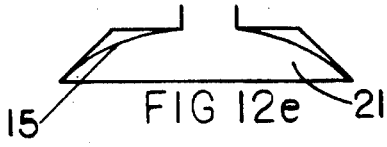
Figure 13A:
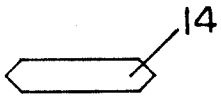
FIGS. 13*a–d* disclose various apertures which may be located in the valve disc.
Figure 13B:
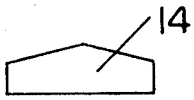
Figure 12F:
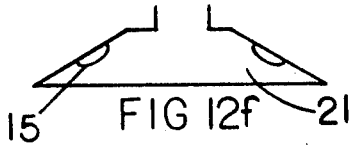
Figure 12G:
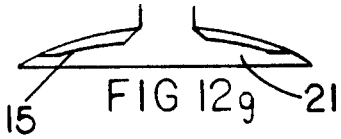
Figure 13C:
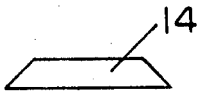
Figure 13D:
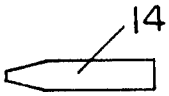
Figure 12H:
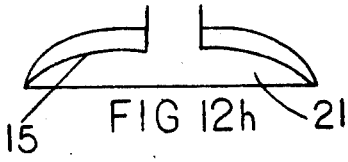

Valve drive means differ slightly from single to multiple cylinder operation. On single cylinder applications, the valve drive comprises a pair of 90-degree bevel gears having a 2:1 ratio. On multiple cylinder applications as illustrated in FIG. 10, a combination of bevel gears and pulleys mounted in tandem is employed as follows: primary drive is taken from the crankshaft in the same manner as a standard OHC Otto cycle engine. At the jacket 17 (analogous to the cylinder head), the drive is transmitted to the first cylinder via a 90-degree, 2:1 ratio, bevel gear set 48 and 48A. The larger crown gear is fitted, by a key or splines to valve stem 30. Crown gear 48A is mounted directly on top of valve drive pulley 98 (keyed) or 38 (splined). The valve drive is transmitted from cylinder #1 to cylinder #2 by a toothed belt 38A running from valve disc pulley 98 or 38 on cylinder #1 valve stem to the lower valve drive pulley 98 or 38 on cylinder #2 valve stem. Another valve drive pulley 38 is mounted on top the lower pulley 98 or 38 cylinder #2 valve stem, which, in turn, transmits the drive to the upper valve drive pulley 98 or 38 on cylinder #3 valve stem, and so on to the particular number of cylinders.

The entire valve drive assembly can be supplied with wet lubrication through the common method of pressure feeding oil from the crankcase upward to the upper external surface of the valve disc jacket 17.

Charge stratification is induced by the creation of a vortex about the centrally located electrode of spark plug 49 through the rotary movement of the valve disc combustion chamber 21, which is effectively the entire combustion chamber. The charge stratification action can be enhanced by the employment of surface irregularities 15, FIGS. 11–13.

Further, the surface irregularities 15 can be arranged in a vane type formation 15A and 15D (FIG. 11*a*,11*b*) for the creation of a pumping action inward toward spark plug 49, in addition to the previously mentioned charge stratification action. The surface irregularities 15 (15A–15C) can serve the additional purpose of balancing the rotating mass of the valve disc unit 1.

Figure 18B:
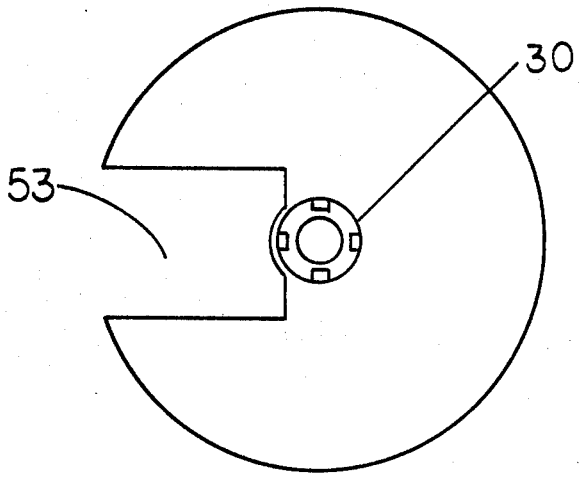
FIG. 18*a* and *b* disclose an alternate embodiment of a side mounted spark plug disc unit.
Figure 18A:
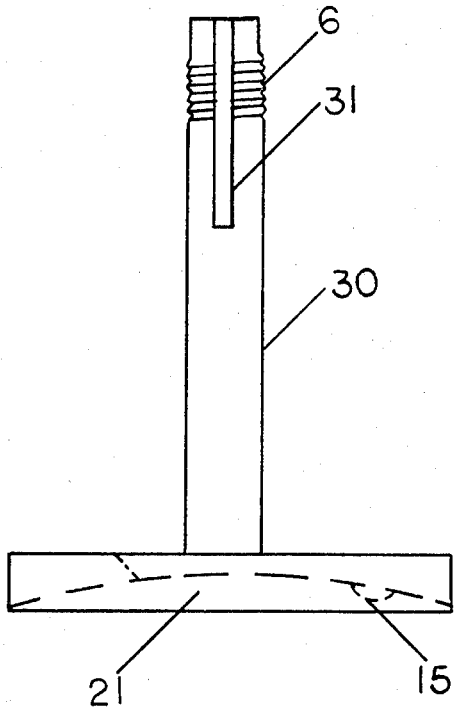

As shown in FIGS. 17 and 18, a second spark plug 49B can be mounted in a suitable recess in the body of valve disc jacket 17 with its firing end exposed to the external surface of the valve disc portion 1 so that at an appropriate point in the rotation of the valve disc unit 1 in the valve disc jacket 17, the firing end of said spark plug 49A will be exposed to the combustion chamber 21 and capable of igniting unburnt inlet charge residuals lingering in the valve disc aperture 14A.

FIG. 16*a* discloses a valve gear cover 34 which is analogous to the common rocker cover on poppet-valve Otto cycle engines. The cover 34 encloses the entire valve drive train as well as providing a rigid locating means for the electrical contact block 36 through the pair of inverted 'L' flanges 37, which flank the spark plug opening 49A and register with the electrical contact block 36 locating grooves 36A. The electrical contact block 36 is further retained by 'S' flange 35A which is mounted to the valve gear cover 34.

Additionally, the valve gear cover 34 provides a means of oil sealing between the inside and the outside of the valve gear cover 34 while providing an opening into the valve stem 30 for transmitting electricity to the spark plug 49. Specifically, a rubber or neoprene oil seal is located in the recess inside the valve stem oil seal housing 88 of the valve drive train cover 34 to maintain dynamic contact with the perimeter of seal-retainer 30C on the vertical thrust seal species valve discs 3 or with the narrowed uppermost perimeter of the valve stem 30 itself on ring seal species valve disc units 1.

The spark plug 49 is charged by the spring metal strip 36B of the previously mentioned electrical contact block 36. The strip 36B is fitted at its lower end with a carbon contact brush 52. Upon assembly, the above-described strip 36B is spring loaded against the side of the spark plug 49 tip, with the carbon contact brush 52 in direct contact as illustrated in FIG. 16*c*.

Continuously variable inlet and exhaust durations can be effected by properly dimensioned diaphragm type pressure differential reactive valves 70 in the inlet passageway, and ceramic ball check type pressure differential reactive valve assembly 46–47 in the exhaust passageway 20. That is, pressure differential reactive valves 70 and 46–47 are automatically operated (opened and closed) by the forces of gas inertia in the inlet 19 and exhaust 20 passageways in a manner commensurate with the engine needs at any given speed.

Further, diaphragm type pressure differential reactive valve action can be controlled directly through gas velocity variations due to the particular shaping of the passageway 19 and the shape and dimensioning of valve disc aperture 14A–14K as well as through employment of the two stage air flow modifier 23.

This automatic regulation commensurate with engine need in all speed ranges is as follows: at low RPMs the diaphragm valve 70 remains open only as long as vacuum (caused by the downward movement of the piston in its cylinder bore on its induction stroke) exists, which lasts for approximately 180° (crankshaft) of the full four cycles (720 crankshaft). This is due to insufficient gas velocity, and thus insufficient gas inertia in the inlet passageway 19 to maintain diaphragm valve 70 in an opened position after the induction stroke. However, as crankshaft RPMs increase, piston speed, and therefore gas velocity increases. As a result, the gases coming through the inlet passageway 19 possess greater inertia and are able to continue flowing past the tongues 70C of diaphragm valve 70 for progressively longer periods after induction vacuum has ceased at BDC. The maximum period for which gases are admitted is set at the valve disc unit 1 in the valve disc jacket 17.

For example, the timing as set at the valve disc unit in the valve disc jacket 17 can be set to provide what is commonly referred to as full-race timing (e.g. 350 inlet, 350 exhaust). With the addition of properly dimensioned pressure differential reactive valves 70 and 46–47 in the inlet 19 and exhaust 20 passageways, respectively, the timing at low RPMs, approximately 800 RPMs, would be appropriately low, in the vicinity of 180 degrees inlet, 180 exhaust (crankshaft). If the crankshaft RPMs were to increase to about 2000 RPMs, the valve timing would increase to approximately 210 inlet, 210 exhaust. At 5000 RPMs, the inlet and exhaust durations would be correspondingly longer, up to a maximum opened period of 350 inlet, 350 exhaust (as set at the valve disc unit in the valve disc jacket 17).

It is understood tht the above-described arrangements are merely illustrative examples of the application. Numerous other arrangements may be readily devised by those skilled in the art which will embody the principles of the invention and fall within the spirit and scope thereof.

We claim:

1. A rotary valve system for internal combustion engines including a valve disc jacket having an aperture therein and predetermined inlet and outlet passages, the combination comprising:

an elongated substantially cylindrical valve passage means having a threaded section at one end and an outwardly extending disc portion at the other end having a downwardly extending circumferential wall with a predetermined aperture extending therealong, said disc portion having a bottom surface comprising the upper surface of a combustion chamber and an upper surface and including at least one shaped protrusion thereon for purposes of charge stratification, a ring seal having a predetermined aperture therethrough for mating with the corresponding aperture in the circumferential wall of the disc portion, said apertures periodically cooperating with the inlet and outlet passages in the valve disc jacket, and, an impregnated sleeve insert mounted between the upper surface of the disc portion and the valve disc jacket to provide a contact running surface that is run dry.

2. A rotary valve system in accordance with claim 1 wherein:

the circumferential wall of the disc portion includes a recess extending about the periphery thereof for engagement with the ring seal and includes a suitable member extending across the recess, said ring seal being substantially circular and having ends including a gap therebetween to engage the suitable member and wherein:

the impregnated sleeve insert comprises a graphite impregnated sleeve and includes an aperture through which the valve passage means extends, said insert being mounted in engagement with the valve disc jacket on its upper surface and outer surface and with the upper and outer surface of the valve disc portion.

3. A rotary valve system in accordance with claim 1 wherein:

the cylindrical valve passage means includes at least one keyway extending axially therealong.

4. A rotary valve system in accordance with claim 1 wherein:

the shaped protrusion comprises a vane-line portion extending downwardly from the lower surface of the disc portion.

5. A rotary valve system in accordance with claim 1 wherein:

the insert comprises a member made of graphite.

* * * * *